US009387576B1

(12) United States Patent
Davis, Jr.

(10) Patent No.: US 9,387,576 B1
(45) Date of Patent: Jul. 12, 2016

(54) FAUCET SEAT AND SPRING INSERTER

(71) Applicant: Winford Davis, Jr., Vandale, AR (US)

(72) Inventor: Winford Davis, Jr., Vandale, AR (US)

( * ) Notice: Subject to any disclaimer, the term of this patent is extended or adjusted under 35 U.S.C. 154(b) by 0 days.

(21) Appl. No.: 14/717,625

(22) Filed: May 20, 2015

(51) Int. Cl.

| | |
|---|---|
| ***B25B 27/00*** | (2006.01) |
| ***E03C 1/04*** | (2006.01) |
| ***B25B 27/30*** | (2006.01) |
| *E03C 1/02* | (2006.01) |

(52) U.S. Cl.
CPC ..... *B25B 27/0028* (2013.01); *B25B 27/304* (2013.01); *E03C 1/04* (2013.01); *E03C 2001/026* (2013.01)

(58) Field of Classification Search
CPC ..... B25B 5/00; B25B 5/067; B25B 5/068; B25B 5/082; B25B 5/125; B25B 27/00; B25B 27/0028; B25B 27/026
See application file for complete search history.

(56) References Cited

U.S. PATENT DOCUMENTS

| | | | | | |
|---|---|---|---|---|---|
| 3,584,365 | A | | 6/1971 | Cuen et al. | |
| 3,844,291 | A | | 10/1974 | Moen | |
| 4,050,148 | A | * | 9/1977 | Hastings | B25B 27/14 279/155 |
| 4,205,435 | A | * | 6/1980 | Holt | H01R 43/22 29/235 |
| 4,304,035 | A | * | 12/1981 | Ecker | B25B 27/26 29/213.1 |
| 5,159,743 | A | * | 11/1992 | Somerville | B25B 27/026 29/252 |
| 5,915,740 | A | | 6/1999 | Weitner | |
| 6,098,277 | A | * | 8/2000 | Hess | B25B 31/00 29/278 |
| 6,895,646 | B1 | * | 5/2005 | Houg | B25B 27/026 29/252 |
| 9,144,898 | B1 | | 9/2015 | Davis, Jr. | |
| 2012/0216380 | A1 | * | 8/2012 | Chen | B25B 27/0021 29/267 |

OTHER PUBLICATIONS

Davis, Jr., Winford; Issue Notification for U.S. Appl. No. 13/718,164, filed Dec. 18, 2012, mailed Sep. 9, 2015, 1 pg.
Davis, Jr., Winford; Notice of Allowance for U.S. Appl. No. 13/718,164, filed Dec. 18, 2012, mailed Jul. 20, 2015, 7 pgs.
Davis, Jr., Winford; Applicant-Initiated Interview Summary for U.S. Appl. No. 13/718,164, filed Dec. 18, 2012, mailed Apr. 22, 2015, 3 pgs.
Davis, Jr., Winford; Final Office Action for U.S. Appl. No. 13/718,164, filed Dec. 18, 2012, mailed May 28, 2015, 10 pgs.
Davis, Jr., Winford; Non-Final Office Action for U.S. Appl. No. 13/718,164, filed Dec. 18, 2012, mailed Feb. 25, 2015, 12 pgs.
Davis, Jr., Winford; Patent Application entitled: Faucet Seat and Spring Inserter having U.S. Appl. No. 13/718,164, filed Dec. 18, 2012, 6 pgs.
Davis, Jr., Winford; Substitute Specification and Replacement Drawings for U.S. Appl. No. 13/718,164, filed Dec. 18, 2012, 9 pgs.

* cited by examiner

*Primary Examiner* — Lee D Wilson
(74) *Attorney, Agent, or Firm* — Taylor English Duma LLP

(57) ABSTRACT

Plumbing devices are disclosed according to examples of the present disclosure. An example plumbing device may include a rod and a handle connected to the rod at a first end of the rod. The plumbing device may further include a body sleeve positioned on the rod between a second end of the rod and the handle. The plumbing device may further include an end sleeve, a first end of the end sleeve positioned on the rod between the body sleeve and the second end of the rod. Additionally, the plumbing device may include a spring positioned on the rod between the end sleeve and the body sleeve.

20 Claims, 7 Drawing Sheets

FAUCET SEAT AND SPRING INSERTER

BACKGROUND

Faucets are devices that control a flow of liquid from a pipe or container by opening or closing an orifice in the faucet housing. Some faucets utilize spring-loaded seals, which have a faucet seat and a seal spring to keep water from running when the faucet is off. When the seals wear out, the faucet leaks and the seals and accompanying springs may need to be replaced.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a plumbing device which overcomes difficulties associated with inserting a faucet seat and seal spring into a faucet housing. The plumbing device includes a housing enclosing a rod, the rod movable upwards and downwards within the housing.

A first end of the rod is connected to a knob in various examples. In examples, the plumbing device includes a sleeve having adjustable handle bars positioned on the outer surface of the housing. When the knob and handle bars of the sleeve are squeezed together, the squeezing causes the knob to push the second end of the rod downward from within the housing and through the housing such that the second end of the rod extends axially outward from an end of the housing to engage a faucet seat and seal spring. A tool spring enclosing the rod and positioned between the knob and the housing biases the rod to retract back into position with the second end of the rod within the housing.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

The plumbing devices of the current disclosure facilitate the easy removal and/or insertion of a faucet seat and seal spring from and/or into a faucet housing because a user does not have to use his or her fingers to remove and/or insert the faucet seat and seal spring.

Disclosed are plumbing devices and associated methods, systems, devices, and various apparatus. It would be understood by one of skill in the art that the disclosed plumbing device is described in but a few examples among many. No particular terminology or description should be considered limiting on the disclosure or the scope of any claims issuing therefrom. Directional references such as "up," "down," "top," "left," "right," "front," "back," and "corners," among others are intended to refer to the orientation as illustrated in the figure (or figures) to which the components and directions are referencing.

A plumbing device is provided in U.S. application Ser. No. 13/718,164, which is hereby incorporated by reference.

Figure 1:
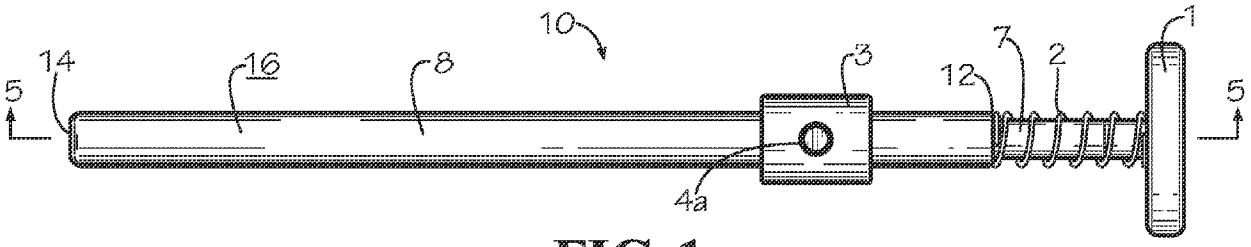
FIG. 1 illustrates a side view of a plumbing device including a rod, a housing, a spring, and a sleeve with adjustable handles according to examples of the present disclosure.

One example of a plumbing device 10 is illustrated in FIG. 1 As illustrated in the example of FIG. 1, the plumbing device 10 includes a knob 1, a tool spring 2, an adjustable sleeve 3 with handle 4*a* and handle 4*b*, a rod 7, and a housing 8.

Figure 3:
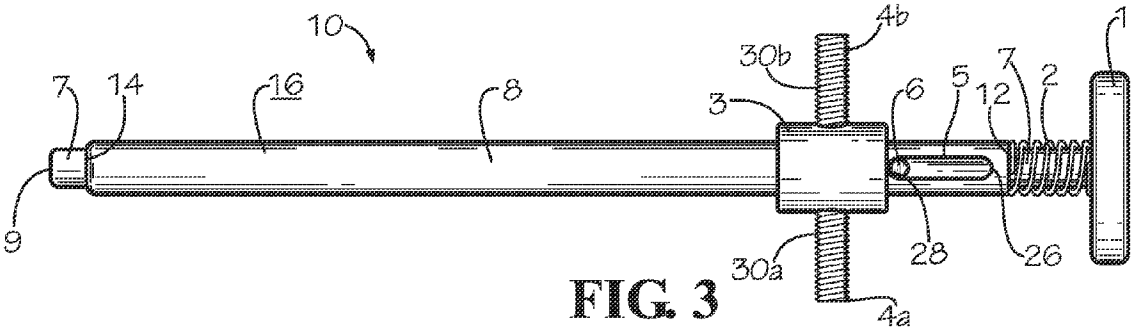
FIG. 3 illustrates a front view of the example plumbing device of FIG. 1 in an extended position according to examples of the present disclosure.
Figure 4:
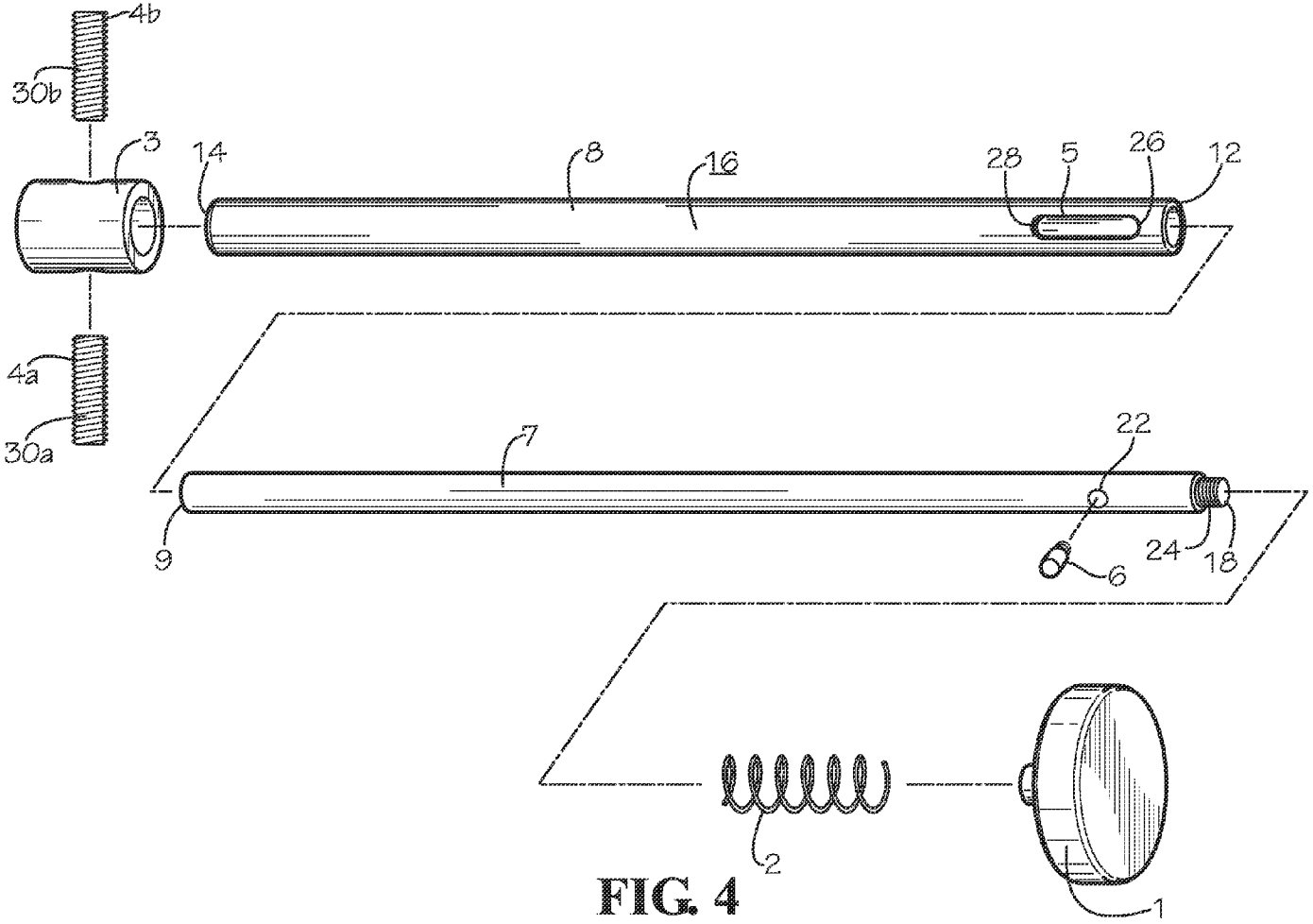
FIG. 4 illustrates an exploded assembly view of the example plumbing device of FIG. 1 according to examples of the present disclosure.

In various examples, the rod 7 includes a first end 18 (illustrated in FIG. 4) and a second end 9 (illustrated in FIG. 3). In various examples, the rod 7 includes threading 24 at the first end 18 (illustrated in FIG. 4). In various examples, the knob 1 engages threading 24 to connect the knob 1 to the first end 18 of the rod 7. In various examples, the rod 7 is a solid rod; however, in various other examples, the rod 7 may have a hollow or partially hollow center. In various examples, the tool spring 2 is positioned on the rod 7 in between a first end 12 of the housing 8 and the knob 1. The shape of the knob 1 should not be considered limiting on the current disclosure as in various other examples, the knob 1 may have any desired shape such as dome-shaped, spherical, or any other desired shape.

The housing 8 includes a first end 12, a second end 14, and an outer surface 16 extending from the first end 12 to the second end 14. In various examples, the housing 8 is an elongated tube with a hollow center extending from the first end 12 to the second end 14. In various examples, a distance from the first end 18 of the rod 7 to the second end 9 of the rod is greater than a distance from the first end 13 of the housing to the second end 14 of the housing 8. As illustrated in FIG. 1, in various examples, a portion of the rod 7 is positioned in the housing 8 and the rod 7 is movably positioned within the housing 8.

As illustrated in FIG. 1, in various examples, the tool spring 2 is positioned around the rod 7 between the housing 8 and the knob 1 such that the tool spring 2 surrounds a portion of the rod 7. In various examples, movement of the knob 1 towards the housing 8 influences the rod 7 to move downward through the housing 8. Movement of the knob 1 towards the housing 8 also compresses the tool spring 2 in various examples.

As illustrated in FIG. 1, in various examples, the plumbing device 10 includes the adjustable sleeve 3 with two handles 4*a,b*. In various examples, the handles 4*a,b* are approximately parallel to each other on each side of the adjustable sleeve 3. In various examples, each of the handles 4*a,b* includes threading 30*a,b* that engages the adjustable sleeve 3 such that the handles 4*a,b* screw inward against the adjustable sleeve 3. In various examples, the handles 4*a,b* are engageable with the outer surface 16 of the housing 8 such that the handles 4*a,b* hold the adjustable sleeve 3 in place at a desired location along the outer surface 16 after adjustably positioning the adjustable sleeve 3 on the outer surface 16 of the housing 8 between the first end 12 and the second end 14.

As previously described, the handles 4*a,b* are engageable and tighten up on the housing 8 to hold the adjustable sleeve 3 in place on the housing 8. In various examples, squeezing the knob 1 towards the handles 4*a,b* compresses the tool spring 2 and influences the rod 7 to move downward through the second end 14 of the housing 8. This is referred to herein as an "extended" position as illustrated in FIG. 3.

Figure 2:
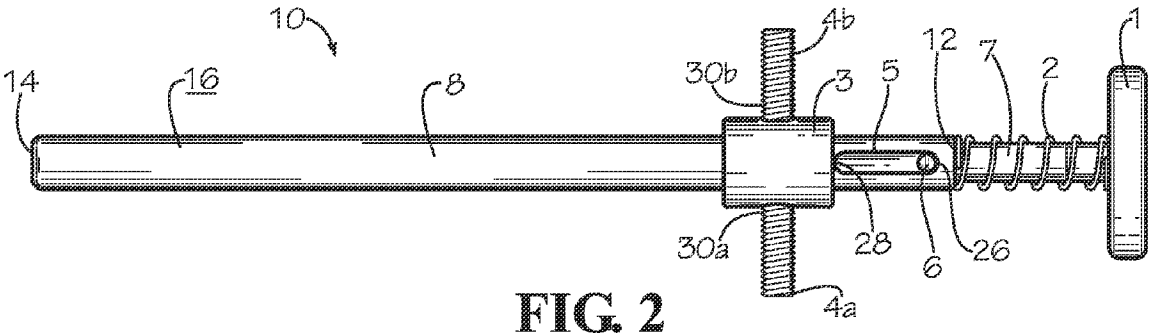
FIG. 2 illustrates a front view of the example plumbing device of FIG. 1 in a retracted position according to examples of the present disclosure.

As illustrated in FIG. 2, in various examples, the housing 8 defines an elongated opening 5 within the outer surface 16 of the housing 8. In various examples, the elongated opening has a first end 26 and a second end 28. In various examples, the rod 7 defines a pin opening 22 (illustrated in FIG. 4) extending transversely through the rod 7. In various examples, a pin 6 is connected to the rod 7. In various examples, the pin 6 is fit into the pin opening 22 of FIG. 4.

As previously described, the pin 6 is fitted into the pin opening 22 extending transversely through the rod 7. In various examples, the pin 6 extends transversely from the rod 7 when the pin 6 is connected to the rod 7. In various examples, the pin 6 connected to the rod 7 extends through the elongated opening 5 of the housing 8 and is contained in the elongated opening 5 of the housing 8. The pin 6 is movably positioned as the rod 7 is movably positioned in the housing 8 such that when the rod 7 is movably positioned through the housing 8, the pin 6 moves within the elongated opening 5 between the first end 26 and the second end 28. By moving within the elongated opening 5, the pin 6 prevents the rod 7 from rotating within the housing 8. The pin 6 also retains the housing 8 on the rod 7 by engaging the elongated opening 5 such that the tool spring 2 biasing against the housing 8 does not disengage the housing 8 from the rod 7.

In various examples, the rod 7 is movably positioned within the housing 8 between a retracted position, illustrated in FIG. 2, and an extended position, illustrated in FIG. 3. In the extended position, the first end 18 of the rod 7 is disposed above the first end 12 of the housing 8 and the second end 9 of the rod 7 is disposed below the second end 14 of the housing 8, as illustrated in FIG. 3. In various examples, the second end 9 of the rod 7 is disposed approximately 5/16 of an inch below the second end 14 of the housing 8. As illustrated in FIG. 3, in various examples, in the extended position, the pin 6 engages the second end 28 of the elongated opening 5.

Figure 5:
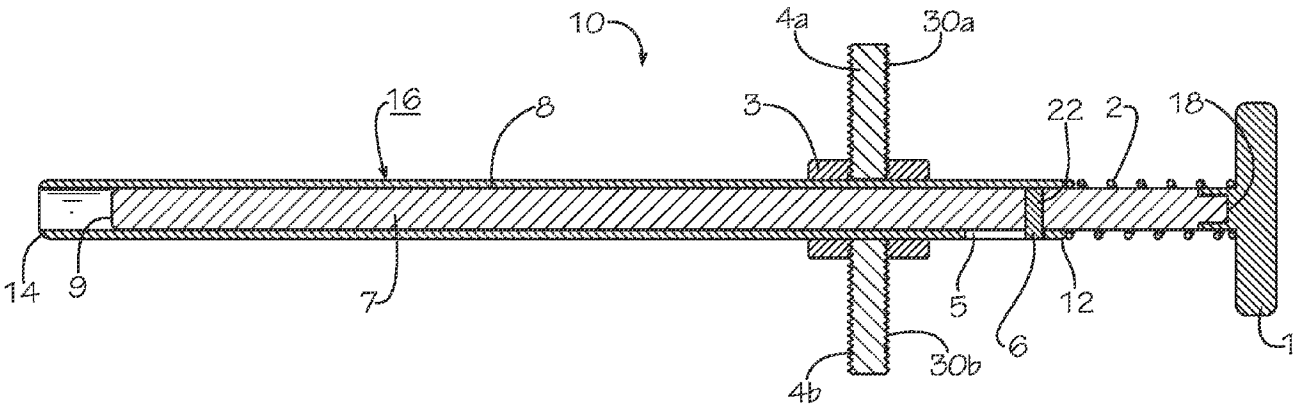
FIG. 5 illustrates a cross-sectional view of the example plumbing device of FIG. 1 taken along line 5-5 in FIG. 1 according to examples of the present disclosure.

In various examples, the second end 9 disposed below the second end 14 enables the second end 9 to engage a faucet seat and spring to be inserted into the faucet's housing. In the retracted position as illustrated in FIG. 2, for example, and the second end 9 is disposed within the housing 8 above the second end 14 of the housing 8, as is partially illustrated in FIGS. 1 and 2 and fully illustrated FIG. 5. As illustrated in FIG. 2, in various examples, in the retracted position, the pin 6 engages the first end 26 of the elongated opening 5. In various examples, the tool spring 2 biases the rod 7 to the retracted position through the knob 1 such that the rod 7 retracts the second end 9 of the rod 7 within the housing 8 when the knob 1 is released by a user.

Figure 6:
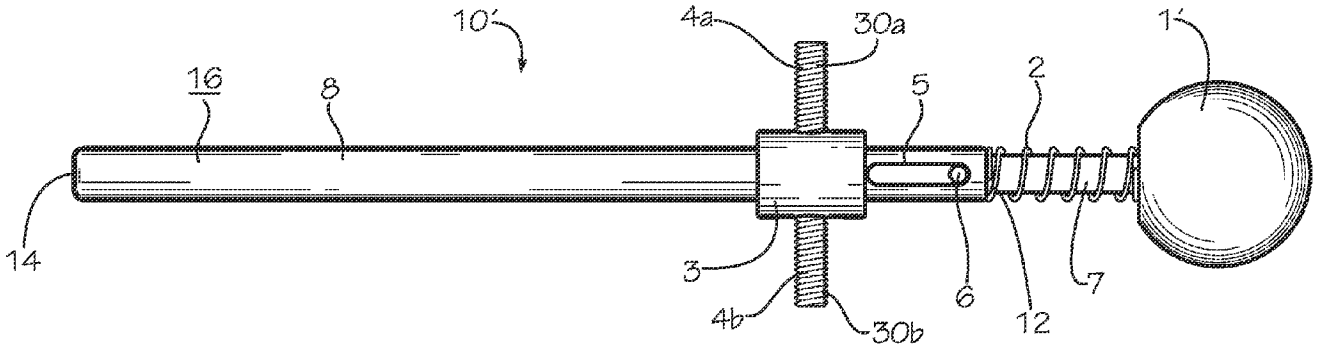
FIG. 6 illustrates a side view of another example of a plumbing device including a knob, a rod, a housing, a spring, and a sleeve with adjustable handles according to examples of the present disclosure.

FIG. 6 shows another plumbing device 10' according to examples of the present disclosure. The plumbing device 10' is similar to plumbing device 10 and includes the rod 7, housing 8, tool spring 2, pin 6, adjustable sleeve 3, and handles 4*a,b*. As illustrated in FIG. 6, the plumbing device 10' includes a spherical knob 1'. The spherical knob 1' functions in a similar manner as knob 1 in that squeezing the knob 1' towards the handles 4*a,b* compresses the tool spring 2 and influences the rod 7 to move downward through the second end 14 of the housing 8. It should be understood that, although a spherical knob 1' is illustrated in FIG. 6, any suitable size and/or shape of knob may be implemented according to examples of the present disclosure.

Figure 7A:
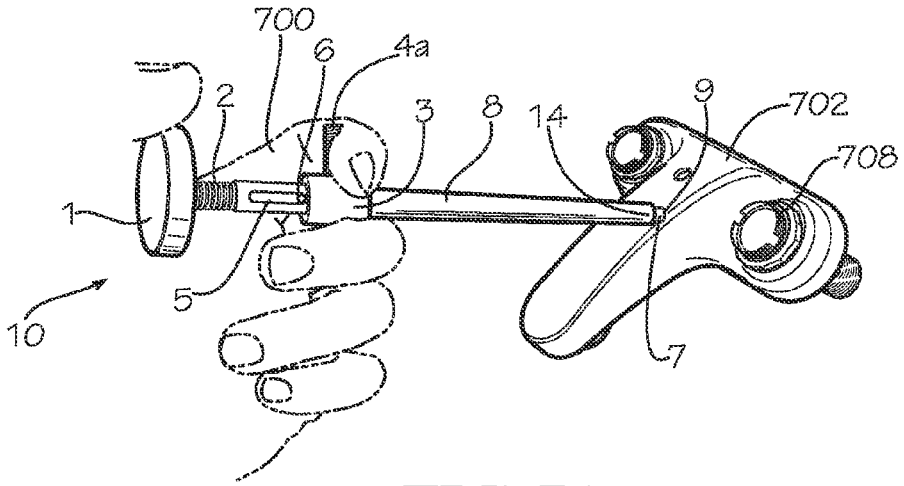
FIG. 7A illustrates a perspective view of the plumbing device of FIG. 1 before insertion into a faucet housing according to examples of the present disclosure.
Figure 7B:
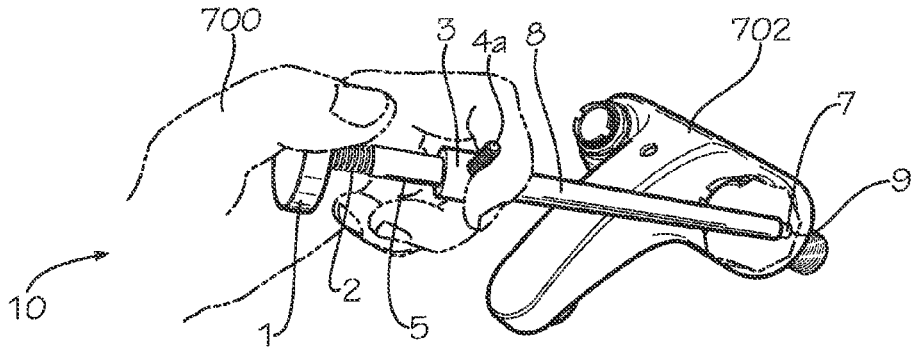
FIG. 7B illustrates a perspective view of the plumbing device of FIG. 1 inserted into a faucet housing according to examples of the present disclosure.
Figure 7C:
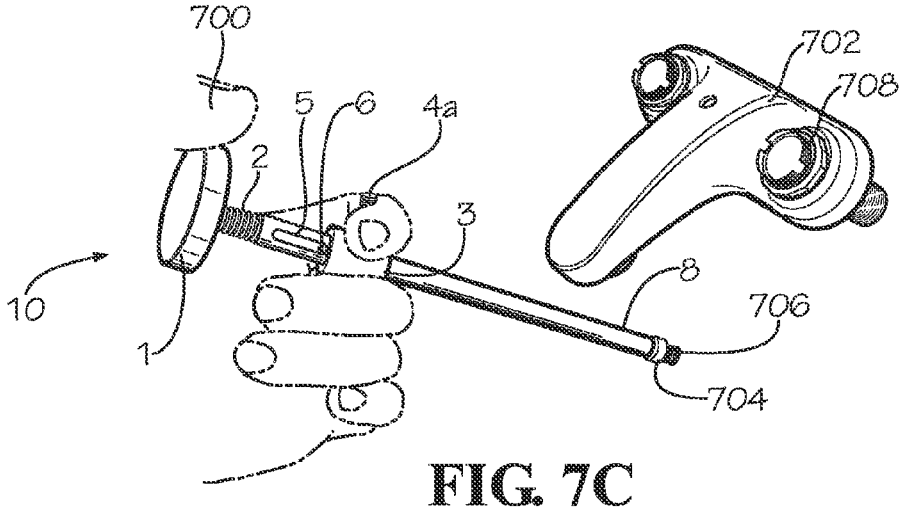
FIG. 7C illustrates a perspective view of the plumbing device of FIG. 1 after removal from a faucet housing according to examples of the present disclosure.

A method of using the plumbing device 10 to remove a faucet seat 704 and faucet spring 706 from a faucet housing 702 is also disclosed. As illustrated in FIG. 7A, a user 700 may hold the plumbing device 10 by the knob 1 and handles 4*a,b* (handle 4*b* not illustrated). The user 700 may squeeze the knob 1 towards the handles 4*a,b*, thereby compressing the tool spring 2 and influencing the rod 7 to move downward through the second end 14 of the housing 8 such that the second end 9 of the rod 7 extends below the second end 14 of the housing 8 (the extended position). As illustrated in FIG. 7B, the user 700 may position the second end 9 of the rod 7 within a valve opening 708 of the faucet housing 702 such that the second end 9 of the rod 7 is positioned within the faucet seat 704 and faucet spring 706 to engage the faucet seat 704 and faucet spring 706. As illustrated in FIG. 7C, while continuing squeezing the knob 1 towards the handles 4*a,b*, the user 700 removes the second end 9 engaged with the faucet seat 704 and faucet spring 706 from the valve opening 708 by retracting the entire plumbing device 10. The user 700 may disengage the faucet seat 704 and faucet spring 706 from the second end 9 by releasing the knob 1 or handles 4*a,b* such that the tool spring 2 is no longer compressed and biases the second end 9 of the rod 7 back within the housing 8 (the retracted position).

A method of using the plumbing device 10 to insert a new faucet seat 704 and faucet spring 706 is also disclosed. The method includes the user 700 squeezing the knob 1 towards the handles 4*a,b*, thereby compressing the tool spring 2 and influencing the rod 7 to move downward through the second end 14 of the housing 8 such that the second end 9 of the rod 7 extends below the second end 14 of the housing 8 (the extend position). The second end 9 of the rod 7 is positioned in the new faucet seat 704 and faucet spring 706 to engage the new faucet seat 704 and faucet spring 706 before positioning the second end 9 into the valve opening as illustrated in FIG. 7B. The second end 9 engaged with the new faucet seat 704 and faucet spring 706 is positioned in the valve opening 708. The user 700 positions the new faucet seat 704 and faucet spring 706 within the valve opening 708 and releases the knob 1 or handles 4*a,b* to disengage the faucet seat 704 and faucet spring 706 from the second end 9 (the retracted position). The user 700 may remove the disengaged second end 9 from the valve opening 708.

Figure 8:
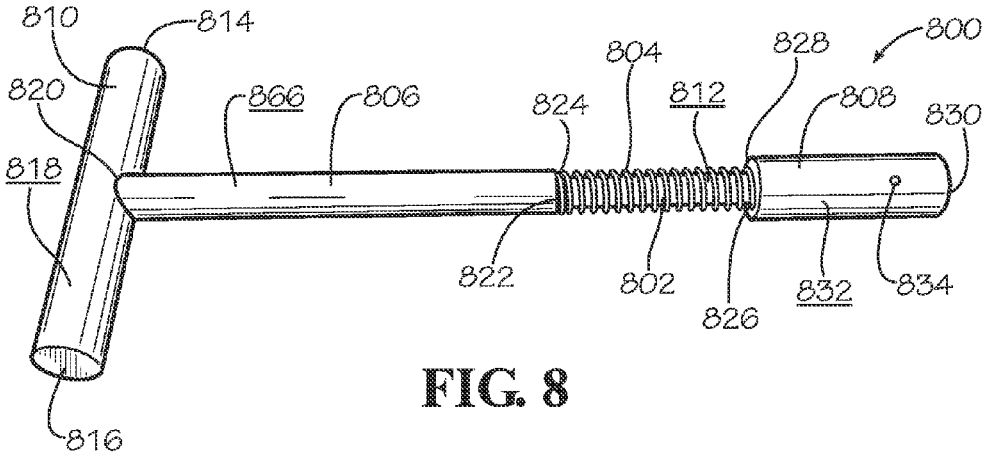
FIG. 8 illustrates a perspective view of another example of a plumbing device, the plumbing device being in a retracted position and including a rod, a spring, a body sleeve, an end sleeve, and a handle according to examples of the present disclosure.

FIG. 8 shows another example of a plumbing device 800. As illustrated in FIG. 8, in various examples, the plumbing device 800 includes a rod 802, a tool spring 804, a body sleeve 806, and end sleeve 808, and a handle 810.

In various examples, the rod 802 includes a first end 838 (illustrated in FIG. 11), a second end 836 (illustrated in FIG. 10), and an outer surface 812 extending between the first end 838 and the second end 836. A distance from the first end 838 to the second end 836 defines a rod length. In various examples, the rod 802 is a sold rod; however, in various other examples, the rod 802 may have a hollow center extending through the rod 802 from the first end 838 to the second end 836. In various examples, the rod 802 is connected to a hub 840 (illustrated in FIG. 11) proximate to the second end 836. In various embodiments, the hub 840 may be integral with the rod 802. For example, in various embodiments, the rod 802 may be machined with a flange at the second end 836; however, in various other embodiments, the hub 840 may be integrally formed with the rod 802 through various other mechanisms. In various embodiments, the hub 840 is connected to the rod 802 through various connecting mechanisms such as adhesives, welding, pins, or various other suitable connecting mechanisms. In various examples, the rod 802 includes threading 842 defined in the outer surface 812 proximate to the first end 838. The rod 802 is described in greater detail below with reference to FIG. 11.

The handle 810 is connected to the rod 802 proximate to the first end 838. In various examples, the handle 810 is connected to the rod 802 through the threading 842 at the first end 838 of the rod 802; however, in various other examples, the handle 810 is connected to the rod 802 through various other connection mechanisms such as nuts, bolts, screws, pins, or various other connection mechanisms. In various examples, the handle 810 is cylindrical and includes a first end 814, a second end 816, and a handle surface 818 extending between the first end 814 and the second end 816. The handle 810 defines a connection bore 820 in the handle surface 818 extending transversely through a part of the handle 810. In various examples, the connection bore 820 includes threading and engages threading 842 of the rod 802 to connect the handle 810 with the rod 802. However, the shape of the handle 810 should not be considered limiting on the current disclosure as in various other examples, the handle 810 may be dome-shaped, circular, spherical, semi-spherical, angled, curved, or have any other desired shape.

The body sleeve 806 includes a first end 844 (illustrated in FIG. 11), a second end 822, and an outer body sleeve surface 866 extending between the first end 844 and the second end 822. In various examples, the body sleeve 806 is an elongated tube with an inner body sleeve surface 850 extending from the first end 844 to the second end 822, thereby defining a hollow center extending from the first end 844 to the second end 822. A distance from the first end 844 to the second end 822 defines a body sleeve length. In various examples, the body sleeve length is less than the rod length. In various examples, the body sleeve 806 is slidable along the rod 802 between the first end 838 and the second end 836 of the rod 802. In various examples, the first end 844 of the body sleeve 806 contacts the handle 810 and the second end 822 contacts the tool spring 804. In various other examples, the body sleeve 806 may be integrally formed with the handle 810.

The body sleeve 806 is positioned on the rod 802 between the first end 838 and the second end 836 of the rod 802 such that the inner body sleeve surface 850 of the body sleeve 806 faces the outer surface 812 of the rod 802. In various examples, the body sleeve 806 is positioned on the rod 802 between the handle 810 and the tool spring 804.

The tool spring 804 includes a first end 824 and a second end 826. In the present example, the tool spring 804 is cylindrically-shaped; however, the shape of the tool spring 804 should not be considered limiting as in various other examples, the tool spring 804 may be conical, convex, concave, or have any other desired shape. As illustrated in FIG. 8, the tool spring 804 is positioned on the rod 802 between the body sleeve 806 and the end sleeve 808. In various examples, the first end 824 of the tool spring 804 engages the second end 822 of the body sleeve 806 and the second end 826 of the tool spring 804 engages a first end 828 of the end sleeve 808. In various examples, the tool spring 804 biases the plumbing device 800 to a retracted position. In this position, the first end 824 of the tool spring 804 biases the body sleeve 806 along the rod 802 such that the first end 844 of the body sleeve 806 contacts the handle 810 connected to the rod 802. The second end 826 of the tool spring 804 biases the end sleeve 808 along the rod 802 such that a collar 846 (illustrated in FIG. 11) of the end sleeve 808 contacts the hub 840 (illustrated in FIG. 11) of the rod 802.

The end sleeve 808 includes the first end 828, a second end 830, and an outer end sleeve surface 832 extending between the first end 828 and the second end 830. In various examples, the end sleeve 808 is an elongated tube with an inner end sleeve surface 848 (illustrated in FIG. 12) extending from the first end 828 to the second end 830, thereby defining a hollow center extending from the first end 828 to the second end 830. A distance from the first end 828 to the second end 830 defines an end sleeve length. In various examples, the end sleeve length is less than the rod length. In various examples, the end sleeve 808 is slidable along the rod 802 between the first end 838 and the second end 836 of the rod 802.

The end sleeve 808 is positioned on the rod 802 such that the first end 828 is between the first end 838 and the second end 836 of the rod 802 and a part of inner end sleeve surface 848 of the end sleeve 808 faces the outer surface 812 of the rod 802. As described in greater detail below, in various examples, the end sleeve 808 defines the collar 846 (illustrated in FIG. 11) at the first end 828 to prevent the first end 828 from sliding over the second end 836 of the rod 802. In various examples, the second end 830 may be positioned above or below the second end 836 depending on whether the plumbing device 800 is in the retracted position (illustrated in FIG. 9) or an extended position (illustrated in FIG. 10). In various examples, in the retracted position, the second end 836 of the rod 802 is disposed within the end sleeve 808 above the second end 830 of the end sleeve 808 between the second end 830 and the first end 828 of the end sleeve 808. In the extended position, the second end 836 of the rod 802 is disposed below the second end 830 of the end sleeve 808.

In various examples, the end sleeve 808 defines a vent opening 834 extending transversely through the end sleeve 808 from the outer end sleeve surface 832 to the inner end sleeve surface 848. In various examples, the vent opening 834 may prevent vacuum formation within the end sleeve 808 as the rod 802 moves between the retracted position and extended position. In examples, the vent opening 834 may be omitted.

Figure 9:
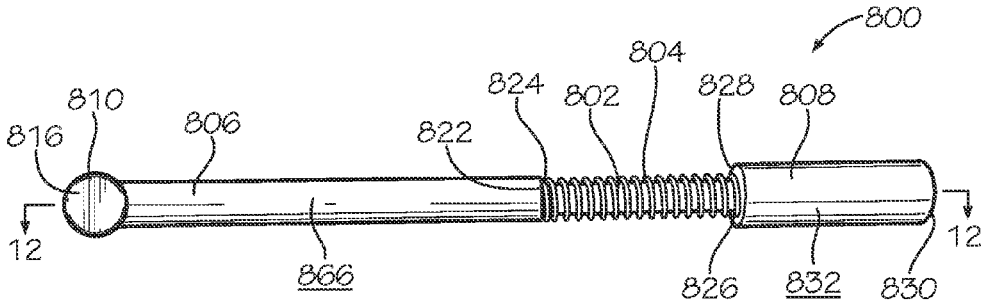
FIG. 9 illustrates a side view of the plumbing device of FIG. 8 in a retracted position according to examples of the present disclosure.
Figure 10:
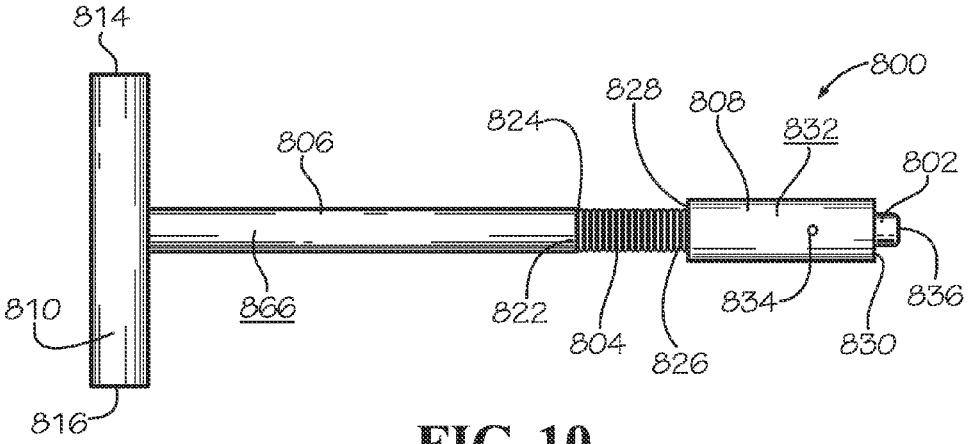
FIG. 10 illustrates a side view of the plumbing device of FIG. 8 in an extended position according to examples of the present disclosure.

FIG. 9 shows a side view of the plumbing device 800 in the retracted position. FIG. 10 shows another side view of the plumbing device 800 in the extended position. As illustrated in FIG. 10, in the extended position, the second end 836 of the rod 802 extends axially outward from the second end 830 of the end sleeve 808. In the extended position, the tool spring 804 is compressed between the body sleeve 806 and the end sleeve 808. In various examples, the tool spring 804 is compressed and the plumbing device 800 is in the extended position when a user engages the second end 830 of the end sleeve 808 on a surface, such as a surface in a faucet housing, and pushes downward on the handle 810.

Figure 11:
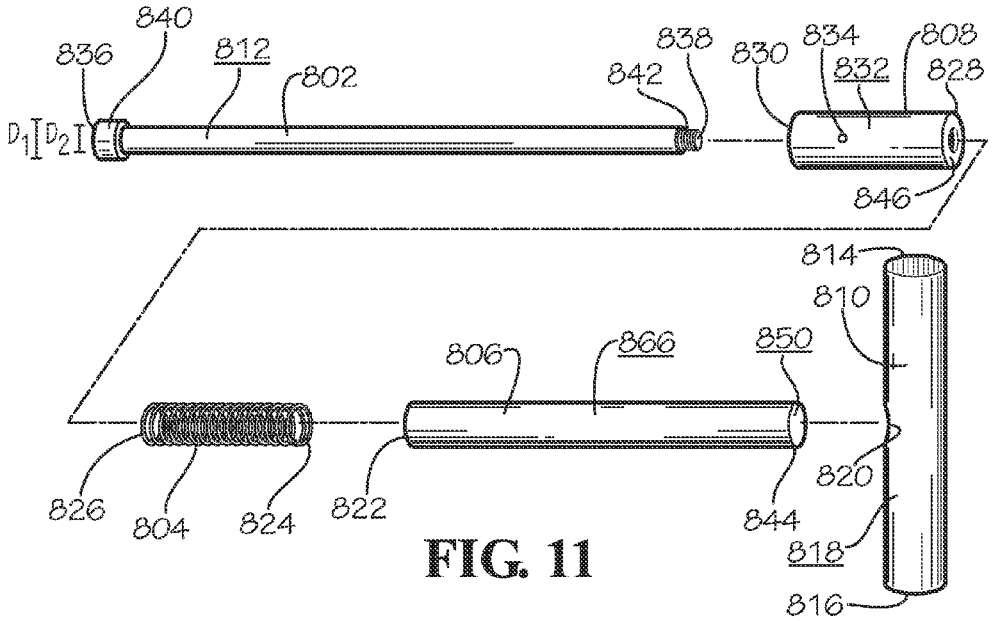
FIG. 11 illustrates an exploded assembly view of the plumbing device of FIG. 8 according to examples of the present disclosure.

FIG. 11 shows an exploded assembly view of the plumbing device 800. As illustrated in FIG. 11, the rod 802 includes the hub 840 connected proximate to the second end 836 in various examples. As illustrated in FIG. 1, in various examples, the hub 840 has a diameter $D_1$ and the rod 802 has a diameter $D_2$. In various examples, the diameter $D_1$ of the hub 840 is greater than the diameter $D_2$ of the rod 802.

Figure 12:
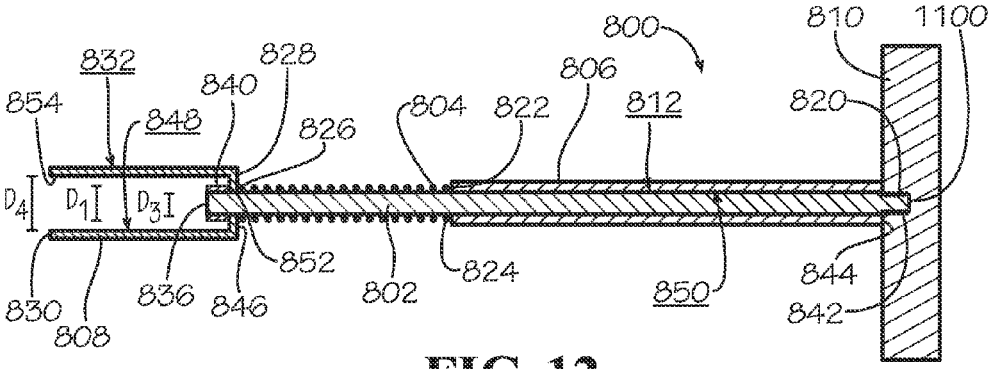
FIG. 12 illustrates a cross-sectional view of the plumbing device of FIG. 8 taken along line 12-12 in FIG. 9 according to examples of the present disclosure.

As illustrated in FIG. 11, the end sleeve 808 includes the collar 846 at the first end 828. In various examples, the collar 846 defines a continuous unbroken circle at the first end 828 of the end sleeve 808. As illustrated in FIG. 12, the collar 846 extends radially inwards from the inner surface 848 of the end sleeve 808 in a direction that is perpendicular to the inner surface 848 of the end sleeve 808. In various examples, the collar 846 is integrally formed with the end sleeve 808; however, in various other examples, the collar 846 is attached to the end sleeve 808 with attachment mechanisms including, but not limited to, welding, adhesives, glues, fasteners, or various other attachment mechanisms.

As illustrated in FIG. 12, in the retracted position, the first end 828 of the end sleeve 808 is positioned on the rod 802 between the first end 838 and the second end 836 of the rod 802. In various examples, the first end 828 of the end sleeve 808 is positioned on the rod 802 between the first end 838 and the hub 840. In the retracted position, the second end 830 of the end sleeve 808 is positioned below the second end 836 of the rod 802.

The collar 846 at the first end 828 of the end sleeve 808 defines a first end opening 852 with a diameter $D_3$. In various examples, the second end 830 of the end sleeve 808 defines a second end opening 854 with a diameter $D_4$. In various examples, the diameter $D_3$ of the first end opening 852 is greater than the diameter $D_2$ of the rod 802 such that the rod 802 may be moved through the first end opening 852. The diameter $D_3$ is less than the diameter $D_1$ of the hub 840 such that the hub 840 may not pass through the first end opening 852. In various examples, in the retracted position, because the hub 840 cannot pass through the first end opening 852, the hub 840 is positioned adjacent to the collar 846 and contacts the collar 846. In various examples, the diameter $D_1$ of the hub 840 is less than the diameter $D_4$ of the second end opening 854 such that the hub 840 may move through the second end opening 854.

Figure 13:
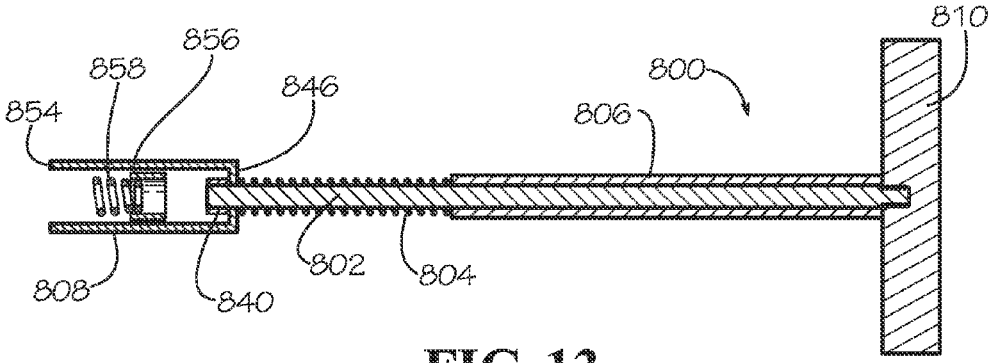
FIG. 13 illustrates a cross-sectional view of the plumbing device of FIG. 8 taken along line 12-12 in FIG. 9 with a faucet seat connected to the plumbing device according to examples of the present disclosure.

FIG. 13 shows the plumbing device 800 in the retracted position with a faucet seat 856 and faucet spring 858 retained within the end sleeve 808. In various examples, a user removing the faucet seat 856 and faucet spring 858 from a faucet housing positions the faucet seat 856 and spring 858 within the second end opening 854 and within the end sleeve 808. Friction between the faucet seat 856 and inner surface 848 of the end sleeve 808 may retain the faucet seat 856 and faucet spring 858 within the end sleeve 808 in the retracted position.

Figure 14A:
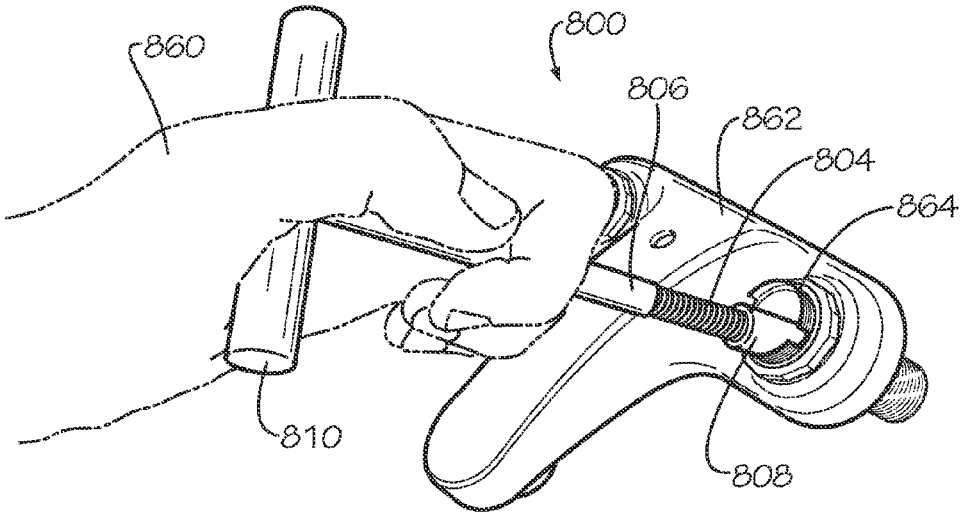
FIG. 14A illustrates a perspective view of the plumbing device of FIG. 8 inserted into a faucet housing according to examples of the present disclosure.
Figure 14B:
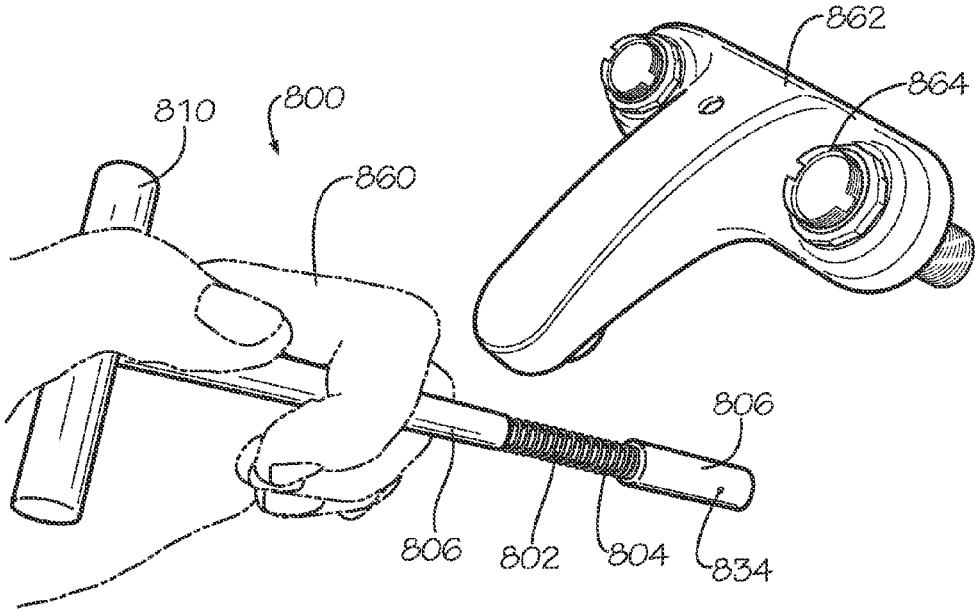
FIG. 14B illustrates a perspective view of the plumbing device of FIG. 8 after removal from a faucet housing according to examples of the present disclosure.

A method of using the plumbing device 800 is also disclosed. As illustrated in FIG. 14A, a user 860 may hold or otherwise grip the plumbing device 800 using the handle 810. The user 860 may also hold the body sleeve 806 in various examples. The user 860 positions the faucet seat 856 and faucet spring 858 within the end sleeve 808 of the plumbing device 800. Friction between the faucet seat 856 and the inner surface 848 of the end sleeve 808 retains the faucet seat 856 and faucet spring 858 within the end sleeve 808. The user 860 positions the second end 830 of the end sleeve 808 containing the faucet seat 856 and faucet spring 858 in a valve opening 864 of a faucet housing 862 such that the second end 830 engages a part of the faucet housing 862 within the valve opening 864. In various examples, the second end 830 engages a part of the housing 862 within the valve opening 864 at a position within the valve opening 864 where the faucet seat 856 (not illustrated in FIG. 14A) and faucet spring 858 (not illustrated in FIG. 14A) are to be inserted.

The user 860 aligns the second end 830 of the end sleeve 808 with the desired position within the valve opening 864 and pushes on the handle 810 to compress the tool spring 804 between the body sleeve 806 and end sleeve 808 and move the second end 836 of the rod 802 below the second end 830 of the end sleeve 808. Movement of the rod 802 through the end sleeve 808 may cause the hub 840 to disengage the faucet seat 856 or faucet spring 858 from within the end sleeve 808 and push the faucet seat 856 and faucet spring 858 out from within the end sleeve 808. In various examples, the second end 836 of the rod 802 may engage the faucet seat 856 and faucet spring 858 to push the faucet seat 856 and faucet spring 858 out from within the end sleeve 808. In various examples, pushing the second end 836 such that the hub 840 at the second end 836 of the rod 802 is positioned below the second end 830 of the end sleeve 808 disengages the faucet seat 856 and faucet spring 858 from the plumbing device 800. However, in various other examples, the second end 836 of the rod 802 may not need to be positioned below the second end 830 of the end sleeve 808 to disengage the faucet seat 856 and faucet spring 858.

The user 860 may stop pushing on the handle 810 after disengagement of the plumbing device 800 with the faucet seat 856 and faucet spring 858. This may return the plumbing device 800 to the retracted position and the hub 840 is repositioned within the end sleeve 808 above the second end 830. In examples, two sets of faucet seat 856 and faucet spring 858 may be inserted within the end sleeve 808, which may be useful to enable the user 860 to install one set of faucet seat and faucet spring into each of the hot and cold water valves of the faucet.

One should note that conditional language, such as, among others, "can," "could," "might," or "may," unless specifically stated otherwise, or otherwise understood within the context as used, is generally intended to convey that certain examples include, while other examples do not include, certain features, elements and/or steps. Thus, such conditional language is not generally intended to imply that features, elements and/or steps are in any way required for one or more particular examples or that one or more particular examples necessarily include logic for deciding, with or without user input or prompting, whether these features, elements and/or steps are included or are to be performed in any particular example.

It should be emphasized that the above-described examples are merely possible examples of implementations, merely set forth for a clear understanding of the principles of the present disclosure. Many variations and modifications may be made to the above-described example(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A plumbing device comprising:

a rod;

a handle connected to the rod proximate to a first end of the rod;

a body sleeve positioned on the rod between a second end of the rod and the handle;

an end sleeve, a first end of the end sleeve positioned on the rod between the body sleeve and the second end of the rod; and a spring positioned on the rod between the end sleeve and the body sleeve.

2. The plumbing device of claim 1, further comprising a hub, the hub connected to the rod proximate to the second end of the rod.

3. The plumbing device of claim 2, wherein:

a diameter of the hub is greater than a diameter of the rod; and the end sleeve defines a first end opening at the first end of the end sleeve, wherein a diameter of the first end opening is greater than the diameter of the rod and less than the diameter of the hub.

4. The plumbing device of claim 2, wherein the body sleeve, the first end of the end sleeve, and the spring are positioned on the rod between the hub and the handle connected to the first end of the rod.

5. The plumbing device of claim 1, wherein the end sleeve includes a collar at the first end of the end sleeve, wherein the collar defines a first end opening and a second end of the end sleeve defines a second end opening, and wherein a diameter of the second end opening is greater than a diameter of the first end opening.

6. The plumbing device of claim 1, wherein in an extended position, the second end of the rod is disposed axially outward a second end of the end sleeve.

7. The plumbing device of claim 1, wherein in a retracted position, the second end of the rod is disposed within the end sleeve between the first end of the end sleeve and a second end of the end sleeve.

8. The plumbing device of claim 7, wherein the spring biases the rod towards the retracted position.

9. The plumbing device of claim 1, wherein the end sleeve includes a vent opening extending transversely through the end sleeve from an outer surface of the end sleeve to an inner surface of the end sleeve.

10. The plumbing device of claim 1, wherein in a retracted position, a hub at the second end of the rod contacts a collar at the first end of the end sleeve.

11. A plumbing device comprising:

a rod;

a handle connected to the rod proximate to first end of the rod;

a spring positioned on the rod between the handle and a second end of the rod; and an end sleeve, a first end of the end sleeve positioned on the rod between the spring and the second end of the rod.

12. The plumbing device of claim 11, further comprising a body sleeve, wherein the body sleeve is positioned on the rod between the spring and the handle.

13. The plumbing device of claim 11, further comprising a hub connected to the rod proximate to the second end of the rod, wherein:

a diameter of the hub is greater than a diameter of the rod; and the end sleeve defines a first end opening at the first end of the end sleeve, wherein a diameter of the first end opening is greater than the diameter of the rod and less than the diameter of the hub.

14. The plumbing device of claim 11, wherein the end sleeve includes a collar at the first end of the end sleeve, wherein the collar defines a first end opening and a second end of the end sleeve defines a second end opening, and wherein a diameter of the second end opening is greater than a diameter of the first end opening.

15. The plumbing device of claim 11, wherein:

the rod includes threading at the first end of the rod; and the handle defines a connection bore extending transversely through a part of the handle and engaging the threading of the rod.

16. A method of using a plumbing device comprising:

gripping a handle of the plumbing device, the plumbing device further including a rod connected to the handle proximate to first end of the rod, a spring positioned on the rod between the handle and a second end of the rod, and an end sleeve, a first end of the end sleeve positioned on the rod between the spring and the second end of the rod;

inserting a faucet seat and a faucet spring within the end sleeve; and engaging the faucet seat and spring with an inner surface of the end sleeve to retain the faucet seat and faucet spring within the end sleeve.

17. The method of claim 16, further comprising:

positioning the end sleeve of the plumbing device in a valve opening of a faucet housing;

engaging the second end of the end sleeve with a part of the faucet housing within the valve opening.

18. The method of claim 17, further comprising engaging a second end of the rod with the faucet seat and faucet spring and disengaging the faucet seat and faucet spring from within the end sleeve.

19. The method of claim 18, wherein disengaging the faucet seat and faucet spring from within the end sleeve includes moving the rod to an extended position, wherein in the extended position the first end of the rod is disposed axially outward the first end of the end sleeve and the second end of the rod is disposed axially outward a second end of the end sleeve, wherein the rod is connected to a hub proximate to the second end of the rod, wherein a diameter of the hub is greater than a diameter of the rod, and wherein the end sleeve defines a first end opening at the first end of the end sleeve, wherein a diameter of the first end opening is greater than the diameter of the rod and less than the diameter of the hub.

20. The method of claim 18, wherein engaging a second end of the rod with the faucet seat and faucet spring includes engaging a hub connected proximate to the second end of the rod with the faucet seat and faucet spring.

* * * * *